US005189746A

United States Patent [19]

Horie

[11] Patent Number: 5,189,746

[45] Date of Patent: Mar. 2, 1993

[54] EMERGENCY PATIENT EVACUATION SYSTEM

[75] Inventor: John P. Horie, Port Moody, Canada

[73] Assignee: British Columbia Mental Health Society, Vancouver, Canada

[21] Appl. No.: 836,521

[22] Filed: Feb. 18, 1992

[30] Foreign Application Priority Data

Mar. 6, 1991 [CA] Canada ..... 2037652

[51] Int. Cl.[5] ..... A61G 1/013

[52] U.S. Cl. ..... 5/627; 5/628; 5/926

[58] Field of Search ..... 5/627, 628, 625, 926; 128/869, 870, 871

[56] References Cited

U.S. PATENT DOCUMENTS

| | | | |
|---|---|---|---|
| 2,351,146 | 6/1944 | Pike | 5/625 |
| 2,899,692 | 8/1959 | Finken | 5/628 |
| 3,135,972 | 6/1964 | Jakes et al. | 5/627 |
| 3,158,875 | 12/1964 | Fletcher | 5/628 |
| 4,124,908 | 4/1978 | Burns et al. | 5/628 |
| 4,442,557 | 4/1984 | Clemens | 5/625 |
| 4,498,557 | 2/1985 | Horne | 182/49 |
| 4,773,505 | 9/1988 | Chiba | 182/49 |
| 5,050,254 | 9/1991 | Murphy | 5/625 |

FOREIGN PATENT DOCUMENTS

| | | | |
|---|---|---|---|
| 381349 | 5/1973 | U.S.S.R. | 5/89.1 |
| 1434832 | 5/1976 | United Kingdom | 5/89.1 |
| 8909039 | 10/1984 | World Int. Prop. O. | 5/628 |

*Primary Examiner*—Alexander Grosz
*Attorney, Agent, or Firm*—Barrigar & Oyen

[57] ABSTRACT

The invention relates to an apparatus for evacuating persons of decreased mobility from a building, such as a hospital, in the event of emergency. It provides a device for moving a supine person by lifting or sliding. The device comprises an elongated, planar, rigid base portion on which the person lies and a lower surface provided with a layer of carpeting for sliding on a surface, flaps having adjustable straps for securing the person on the base portion, handles attached to each end of the base portion whereby the device may be pulled from either end, and handles attached to both sides of the base portion whereby the device may be lifted from said both sides.

12 Claims, 3 Drawing Sheets

EMERGENCY PATIENT EVACUATION SYSTEM

FIELD OF THE INVENTION

The invention relates to apparatus for evacuating persons of decreased mobility from a building, such as a hospital, in the event of emergency.

BACKGROUND OF THE INVENTION

Hospitals and similar institutions which house relatively immobile or non-ambulatory patients require a system for evacuation of such patients in the event of fire or other emergencies. Such evacuation may involve descending stairways as well as moving across a level surface. In the past, the patient's mattress has been used to transport the patient by securing the mattress around the patient with ropes or straps and dragging the mattress by means of the ropes or straps. Such a method generally requires at least two attendants to secure the patient in the mattress and then move the mattress and patient. Further, mattresses are bulky and difficult to manoeuvre down stairs, or into an ambulance.

It is important in devices of this type that the device be easily and compactly stored for quick access in the event of emergency and further that the device provide sufficient protection to the patient while being moved, for example when descending stairs or when the patient is left outside the building in the elements.

SUMMARY OF THE INVENTION

A device for moving a supine person by lifting or sliding is provided. The device comprises a) an elongated, planar, rigid base portion having a length and width greater than the length and width of said person to be moved, said base portion having an upper surface on which said person lies and a lower surface adapted for sliding on a surface;

b) means for releasably securing said person on said base portion;

c) handle means attached to one end of said base portion whereby said device may be pulled from said one end; and d) handle means attached to both sides of said base portion whereby said device may be lifted from said both sides.

BRIEF DESCRIPTION OF THE DRAWINGS

In drawings which illustrate a preferred embodiment of the invention.

DETAILED DESCRIPTION OF THE PREFERRED EMBODIMENT

Figure 1:
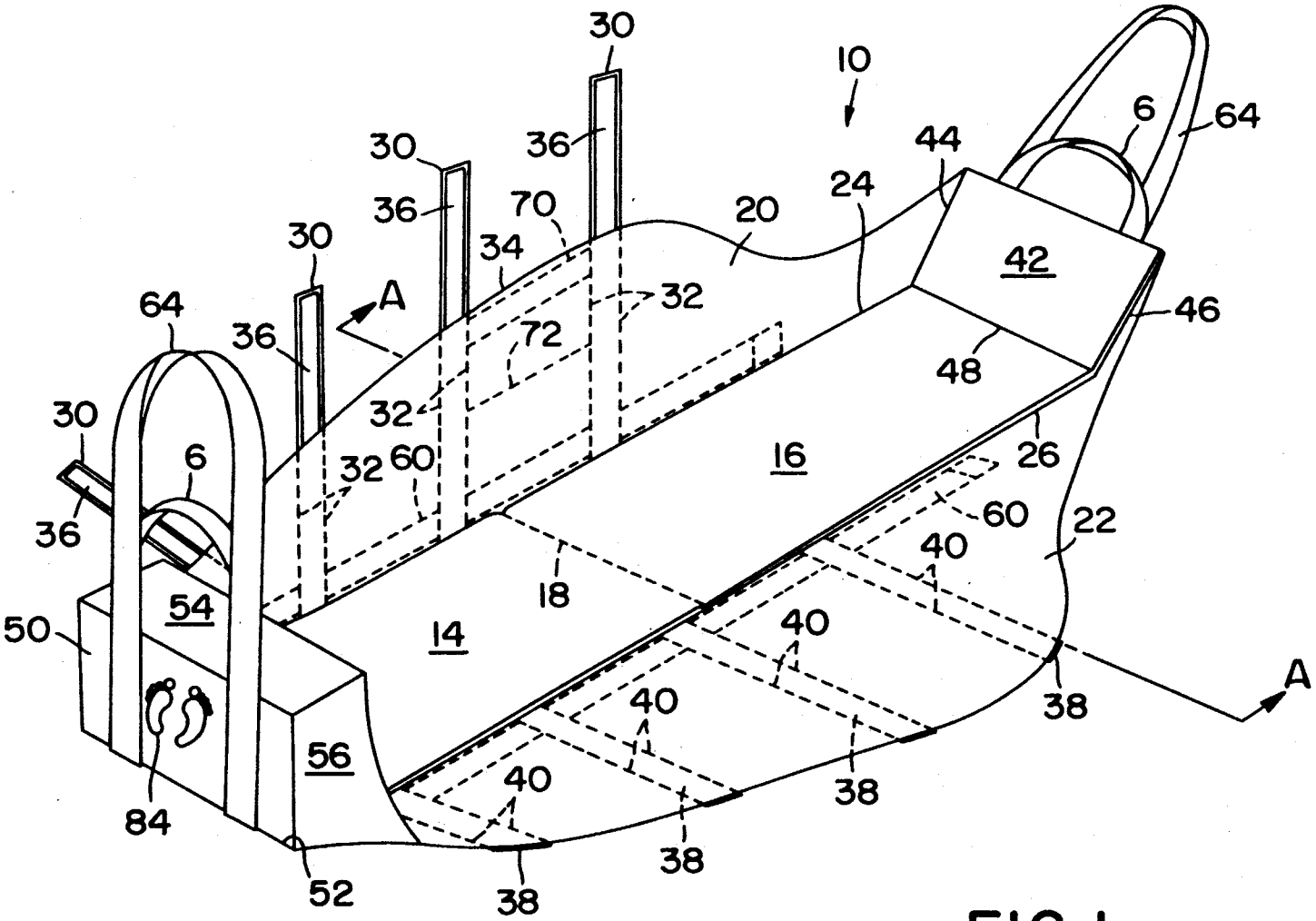
FIG. 1 is a perspective view of the invention.

With reference to the drawings, the apparatus of the invention is designated generally as 10. The apparatus is constructed using a fire-resistant synthetic outer shell or covering 66, such as that sold under the trade-mark STAPHCHEK. It has a rectangular bottom section 12 which is approximately 75 inches long by 17 inches wide and is separated into two halves 14 and 16 by stitching 18. Side flaps 20 and 22 are joined to the bottom portion 12 along edges 24 and 26. Each flap 20 and 22 is about 19 inches high at its highest point. Four adjustable securement straps 30 are secured to flap 20 at spaced locations, as shown in FIG. 1, by lines of stitching 32. The straps 30 vary in length so that a free end about 12 inches long extends beyond the edge 34 of the flap. The inner surface each of the ends of flaps 30 is provided with a strip 36 of the hook portion of a VELCRO TM hook-and-loop fastener. Complementary strips of the loop portion 38 of a VELCRO TM fastener are stitched to the outside surface of flap 22 along lines of stitching 40.

A rectangular head piece 42 extends between the two ends of flaps 20 and 22 and is attached to the flaps along edges 44 and 46 respectively and to the bottom portion along line 48. A foot piece 50 extends between the opposite ends of flaps 20, 22 and is joined to bottom portion 12 along line 52. Head piece 42 and foot piece 50 are both about 11 inches in height. Foot piece 50 also has a rectangular top panel 54 and side panels 56 extending at right angles to it. Carrying straps 60 (shown in dotted outline in FIG. 1) are secured to side flaps 20 and 22 along each lower edge. They are stitched at each strap 30 and at each end 62, leaving intermediate areas free for grasping by a hand for, vertical lifting of the apparatus.

Pulling straps 64 are stitched to the head and foot pieces 42 and 50 as shown, extending about 29 inches beyond the edge of the foot or head piece. A second pulling strap 6 is attached to strap 64, extending only about 16 inches beyond the head or foot piece. The different sizes of straps 64 and 6 accommodate pulling or guiding of the apparatus by individuals of different heights.

Figure 2:
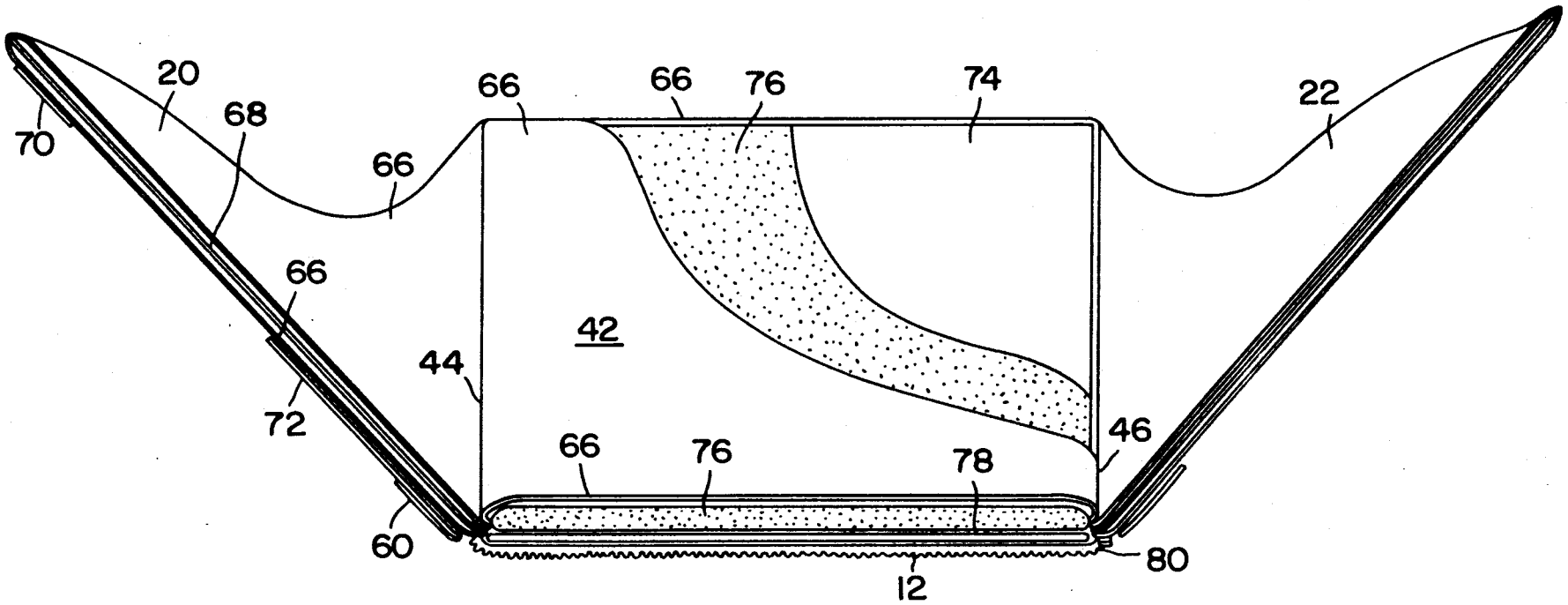
FIG. 2 is a cross-sectional view taken along lines A—A of FIG. 1, with the cover material of the head piece partially cut away.
Figure 3:
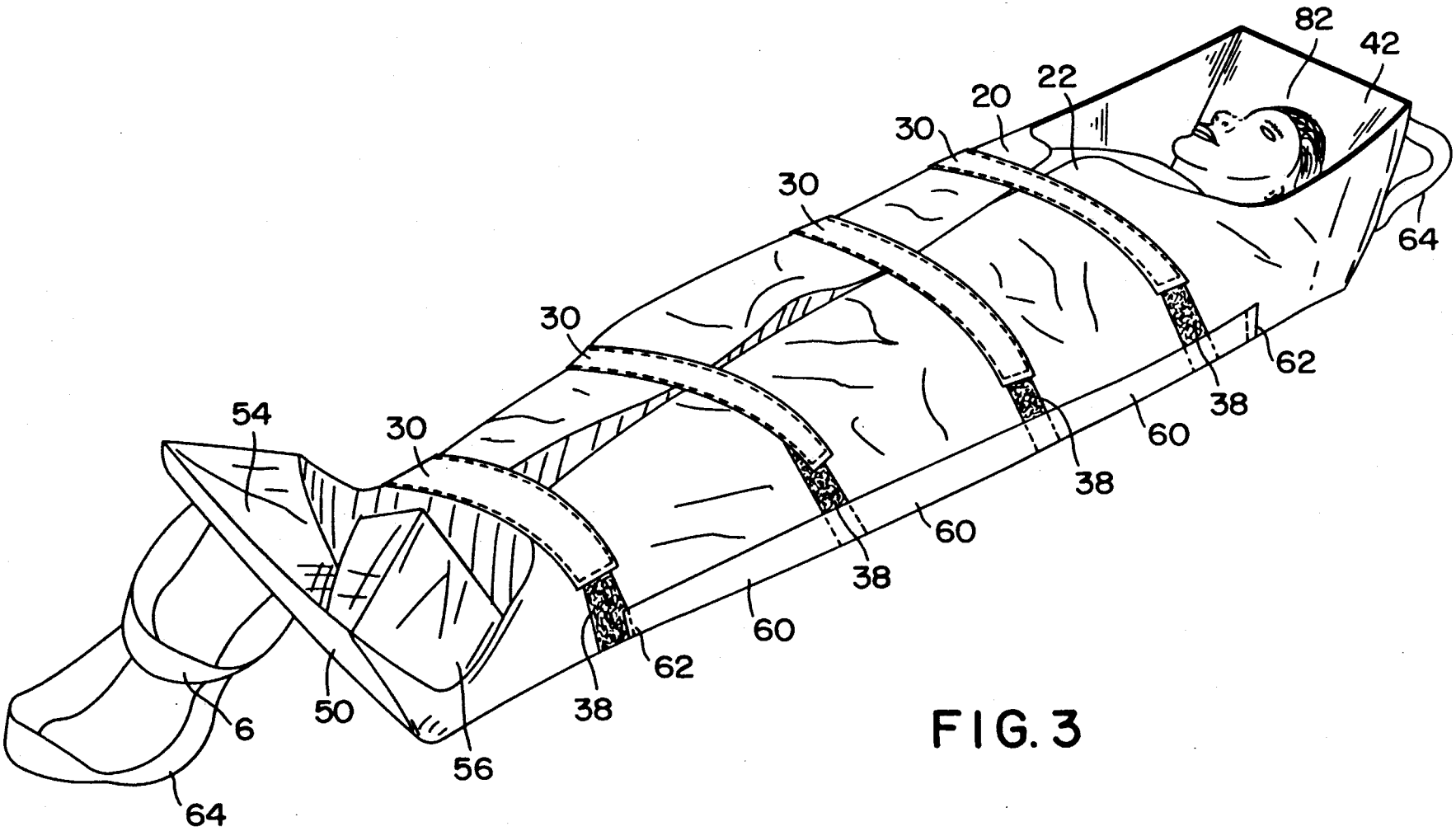
FIG. 3 is a perspective view of the invention with a patient strapped in place for evacuation.

With reference to FIG. 2, the apparatus is covered with a synthetic weather and fire resistant material 66 such as that sold under the trade-mark STAPHCHEK. Side flaps 20 and 22 have a canvas core 68 to provide additional stiffness. Attached to flap 20 is a reflective strip 70 for better visibility of the apparatus in reduced lighting conditions, and a clear plastic pouch 72 for storing patient charts, medicine, intravenous bags etc.

Head piece 42 and foot piece 50 are formed of a sandwich of ¼-inch hardboard core 74 and ½-inch foam rubber cushion 76 on the inner surface of board 74. The bottom portion 12 is formed of two separate plates 78, one nearer the head piece end and one nearer the foot piece end. The plate nearest the foot piece is formed of a 3/16-inch high density, lightweight plastic plate on the bottom covered by ½-inch foam rubber cushion 76. The plate nearest the head piece is formed of a ⅛-inch aluminum plate also covered by ½-inch foam rubber cushion. Stitching 18 separates the two plates 78 into two separate pockets of the covering material 66. The underside of lower portion 12 is covered with a layer of pile carpeting 80 to facilitate the sliding of the apparatus.

The apparatus is stored by folding flaps 20, 22 over bottom portion 12, with straps 30 fastening to carpeting 80. Head piece 42 and foot piece 50 are then also folded over bottom portion 12. Bottom portion 12 is then folded along line 18. An additional, separate hook and loop strap can be used to hold the apparatus securely in the folded configuration and a plastic dust cover may be used. Carrier compartments may be provided under the patient beds for storage of the apparatus.

To utilize the apparatus, the patient 82 is rolled to one side on the bed and the apparatus is aligned alongside the patient with the foot end, marked with a pair of feet at 84, alongside the patient's feet, and the side flap 20, 22 which is closest to the patient tucked under the patient. The patient 82 is then rolled to the centre of the apparatus with his head adjacent head piece 42. Flaps 20, 22 are folded over the patient and drawn snugly over the patient by securing hook and loop strips 36 of straps 30 to strips 38. Attendants can then carry the patient using carrying straps 60, or can slide the patient off the bed by rotating the apparatus and pulling straps 64 or 66, with the patient's head going first off the bed and one attendant at each end of the apparatus. If necessary, one attendant can accomplish sliding the patient from the bed to the floor in this way and then transporting the patient by sliding. To transport the patient, the foot end is pulled first, with the carpeted bottom surface 80 facilitating sliding. In descending stairs, the foot end descends first. Plates 78 prevent injury to the patient's back and facilitate sliding down the stairs, while head and foot pieces 42, 50 provide added protection to the patient. By using straps 60, two attendants can lift the device and enclosed patient vertically onto a stretcher or into an ambulance.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A device for evacuating a non-ambulatory patient by lifting or sliding, without the use of a mattress, comprising:

a) an elongated, planar, rigid base portion having a length and width greater than the length and width of said patient when supine, said base portion having an upper surface on which said patient lies and a lower surface adapted for sliding on a surface;

b) a cushioning layer secured to the upper surface of said base portion of sufficient thickness to cushion said patient during evacuation;

c) means for releasably securing said person on said base portion;

d) handle means attached to one end of said base portion whereby said device may be pulled from said one end;

e) handle means attached to both sides of said base portion whereby said device may be lifted from said both sides;

f) a rigid head piece hingedly secured to said base portion at one end thereof and adapted to shield the top of said patient's head when said patient is secured to said base portion; and g) a rigid foot piece hingedly secured to said base portion at the opposite end thereof to said head piece, and adapted to shield the bottom of said patient's feet when said patient is secured to said base portion;

whereby when in use said patient is secured to said base portion, and said lower surface of said base portion forms a rigid planar sliding surface larger in dimension than the length and width of said supine patient.

2. The device of claim 1 wherein said rigid base portion is adapted for folding by being centrally hinged.

3. The device of claim 1 wherein said rigid base portion is provided on its underside with means for facilitating sliding.

4. The device of claim 3 wherein said means for facilitating sliding comprises pile carpeting.

5. The device of claim 1 wherein said means for releasably securing comprises adjustable straps.

6. The device of claim 5 wherein said means for releasably securing comprises flexible flaps attached to said base portion along each side thereof for folding over said patient.

7. The device of claim 6 wherein said base portion and flaps are covered with a fire-resistant material.

8. The device of claim 6 wherein said base portion, flaps, foot piece and head piece are covered with a fire-resistant material.

9. The device of claim 1 comprising handle means at both ends of said base portion for pulling said device.

10. The device of claim 9 wherein said handle means comprises handle means of two different lengths.

11. The device of claim 1 wherein said handle means are constructed of a flexible material.

12. The device of claim 1 wherein said foot piece is provided on one side thereof with an identifying marking.

* * * * *